United States Patent [19]

Ackerfeldt

[11] 4,353,276

[45] Oct. 12, 1982

[54] ARRANGEMENT IN MACHINES FOR PROCESSING LOGS, BLOCKS AND LIKE WORKPIECES

[76] Inventor: Bo I. Ackerfeldt, Ahusvägen 44, 260 90 Bastad, Sweden

[21] Appl. No.: 151,641

[22] Filed: May 20, 1980

[30] Foreign Application Priority Data

May 29, 1979 [SE] Sweden ..... 7904678

[51] Int. Cl.[3] ..... B27B 31/04

[52] U.S. Cl. ..... 83/708; 198/394; 198/570; 198/692; 198/733; 83/364; 83/367; 83/731; 83/422; 83/423; 83/425; 414/745; 144/245 A; 144/378

[58] Field of Search ..... 198/344, 345, 394, 570, 198/692, 693, 732, 733, 735; 144/245 R, 245 D, 245 E, 245 A, 312; 83/367, 708–712, 731, 364, 423, 422, 425; 414/431–433, 745

[56] References Cited

U.S. PATENT DOCUMENTS 2,780,343 2/1957 Bunnell ..... 198/732
3,608,700 9/1971 Nilsson ..... 198/692
4,147,259 4/1979 Nilsson ..... 414/745
4,152,960 5/1979 Detjen ..... 144/312

*Primary Examiner*—Joseph E. Valenza
*Attorney, Agent, or Firm*—Browdy and Neimark

[57] ABSTRACT

An arrangement in sawing machines or like processing machines for the forward feeding and infeeding of work pieces, such as logs in particular, to the machine, comprising a stationary saw table which extends parallel to the desired feed line for the workpiece, at least up to the sawing machine, and at least two, individually drivable, endless feed chains which extend in vertical planes parallel with the feed line beneath the saw table. Each of the feed chains is provided with at least one dogging means which moves in a groove in the saw table. The groove is parallel with the feed line and common to all dogging means. The dogging means projects up out of the groove, above the surface of the saw table, in a manner to enable the dogging means to act on the rear end surface of a work piece resting on the saw table, for feeding said workpiece up to and into the sawing machine.

15 Claims, 14 Drawing Figures

ARRANGEMENT IN MACHINES FOR PROCESSING LOGS, BLOCKS AND LIKE WORKPIECES

Figure 3:
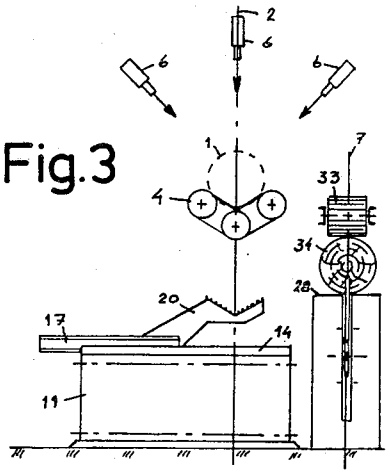

The present invention relates to an arrangement in machines for processing such workpieces as logs, blocks and the like, and more particularly to apparatus for aligning the workpieces and feeding the same in and through the processing machines.

When feeding, for example, logs through a saw, it is important that the logs are so positioned laterally that the highest possible yield is obtained, and that the position of crooked or curved logs is so adjusted that the curve in a log is oriented substantially vertically. In order to achieve the highest possible production output, it is an advantage to rotate the logs, so as to orient any curves therein in said substantial vertical direction, on one side of the infeed line to the saw, hereinafter referred to as the saw line, whereafter the logs are moved in parallel to the saw line while maintaining the adjusted position of rotation. A number of such apparatus are previously known from, for example, the Swedish patent specification Nos. 322 895, 317 180 and 353 508, although all of the known apparatus suffer certain disadvantages. For example, the means which effect the parallel movement of the logs are liable to engage a knot or some other irregularity on the surface of the logs, therewith disturbing the desired adjusted position thereof. Similarly, the devices to which the logs, after said parallel movement, are delivered for feeding into the saw are often so constructed that no guarantee can be given that the obtained rotary position of the logs will be retained. Furthermore, it is at times desireable to move the logs laterally relative to the saw line, since the ideal line along which a log should be sawn does not always coincide with the centre line through the end surfaces of the log. It may also be desireable to position a log obliquely relative to the saw line, for example so that one outer cylindrical surface of the log is parallel with said saw line. Even though a log has been placed in the saw line in the desired position, it has been found difficult with devices known hitherto to grip the log and to advance the same up to and through the saw without the adjusted position of the log being changed. This problem has become particularly acute with the introduction of reducers. Reducers act on the logs with greater forces than do sawblades. The reducer forces the log to one side and to rotate about its longitudinal axis.

Qualified tests have shown that an operator is able to rotate the logs so as to position any curves therein in the aforedescribed manner quite satisfactorily, provided that the capacity of the mill is not excessively high. The operator, however, is not able to align the logs laterally in a satisfactory manner, even when he is under no pressure with regard to time. Consequently, it would be to advantage if the aforementioned processing steps were completely automated.

The object of the present invention is to provide an improved apparatus of the kind mentioned in the introduction which eliminates, or substantially reduces the afore discussed disadvantages associated with previously known apparatus.

Accordingly, this invention consists in an arrangement in a saw machine or like processing machine, for advancing workpieces, in particular logs, to and through the sawing machine, said arrangement including a stationary saw table extending on the infeed side of the sawing machine parallel with the desired feed line for the workpiece at least up to said machine; and feed means arranged to engage a workpiece resting on said saw table and to feed said workpiece along said table up to and into the sawing machine, wherein said feed means comprises at least two, individually drivable, endless feed chains extending beneath the saw table in vertical planes parallel with the feed line, each feed chain being provided with at least one dogging means which, when located on the upper part of the feed chain, moves in a groove which is formed in the saw table and which is common to the dogging means of all feed chains, and projects out of said groove above the surface of the saw table in a manner such that the upwardly shooting part of said dogging means is able to act on the trailing end surface of a workpiece resting on the saw table and feed said work piece up to and into the saw machine.

Figure 4:
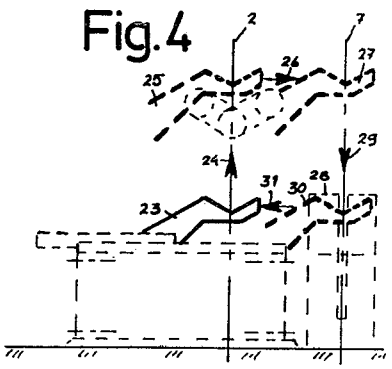
Figure 2:
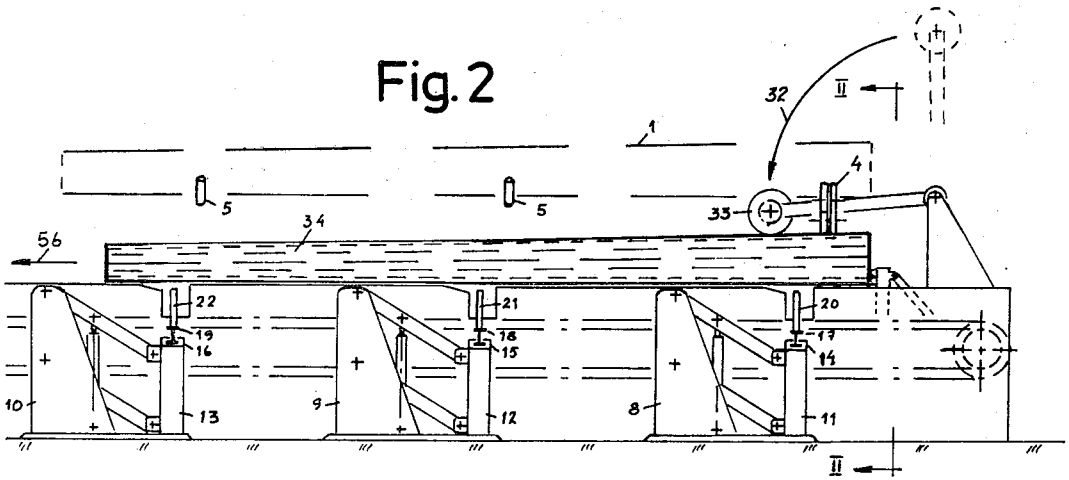
Figure 1:
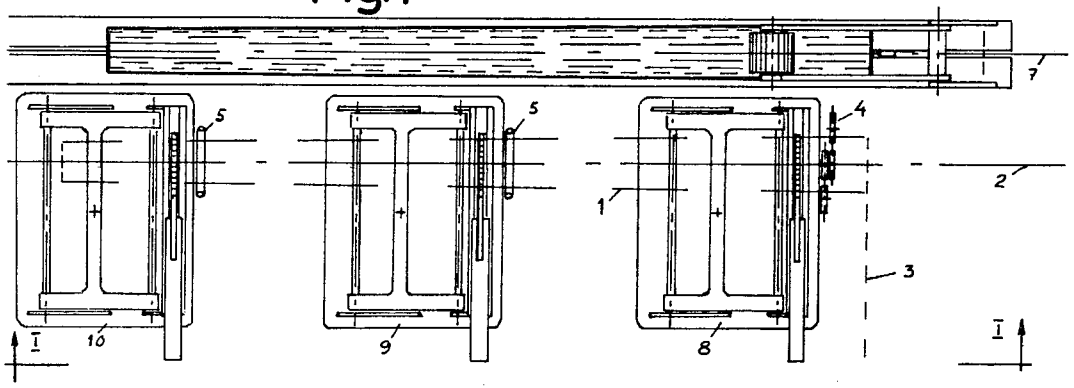
Figure 7:
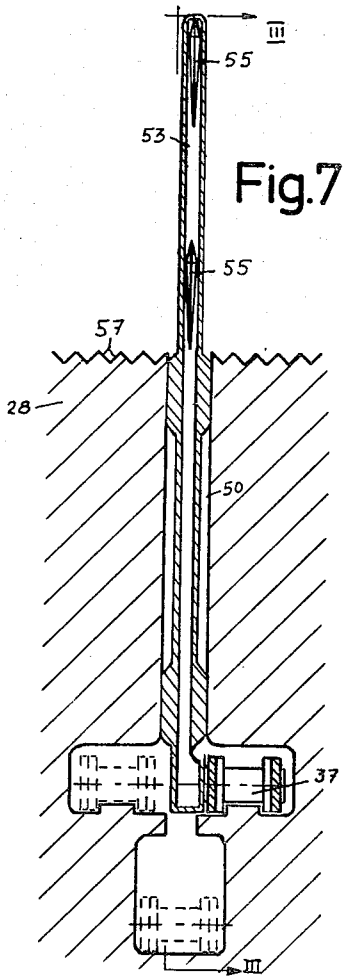
Figure 6:
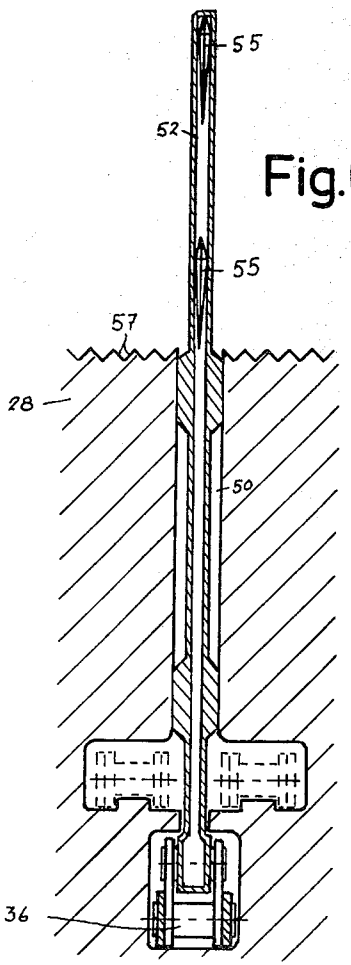
Figure 5:
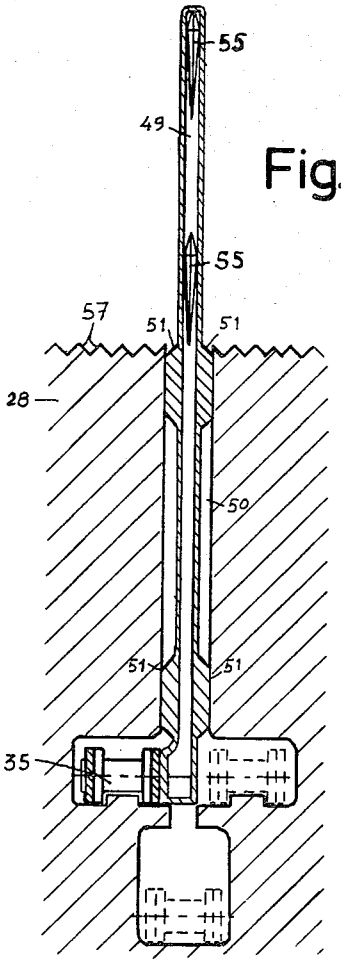
Figure 8:
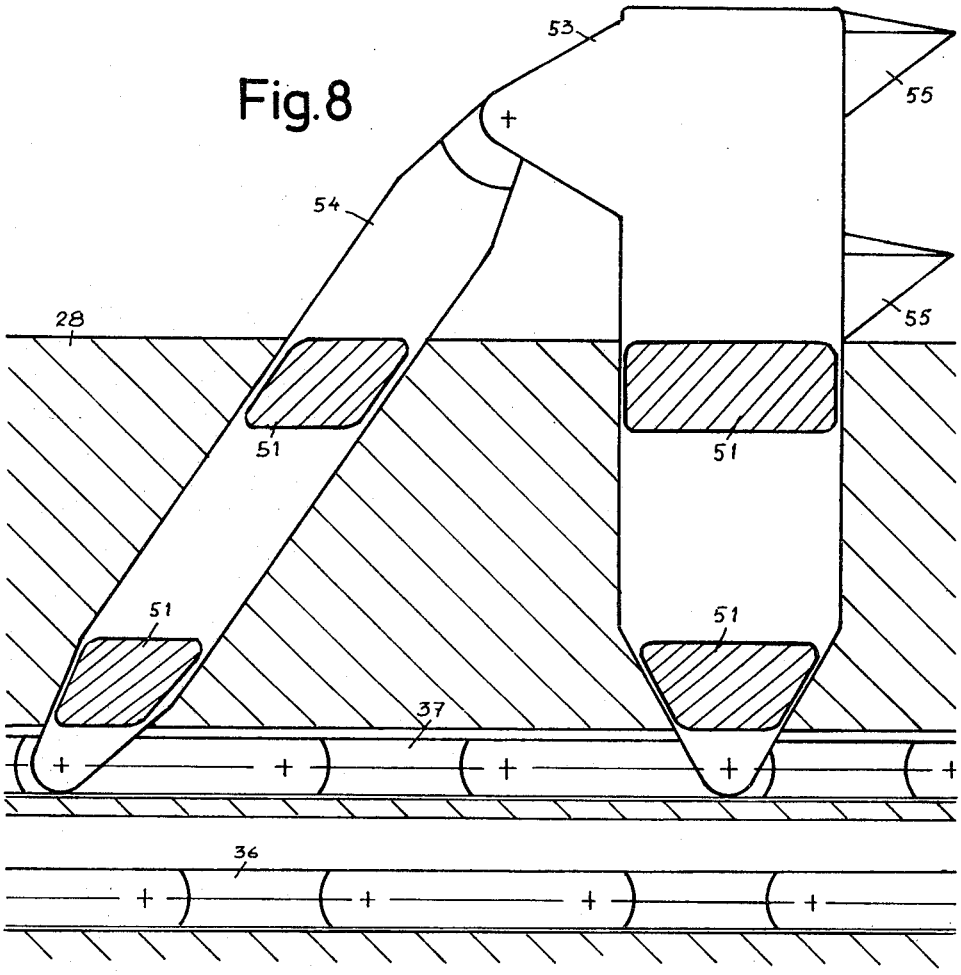
Figure 9:
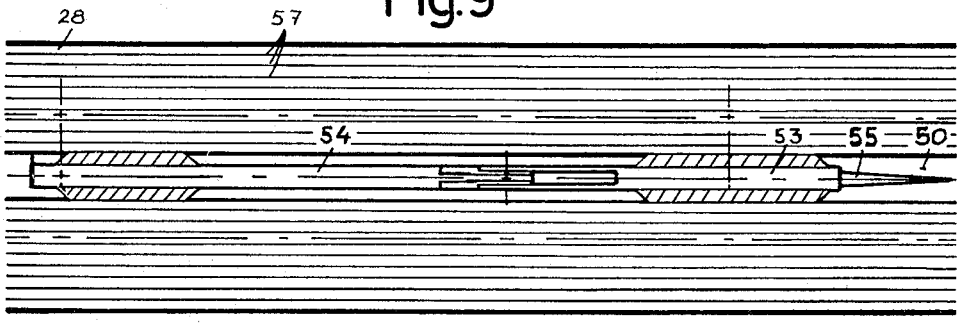
Figure 10:
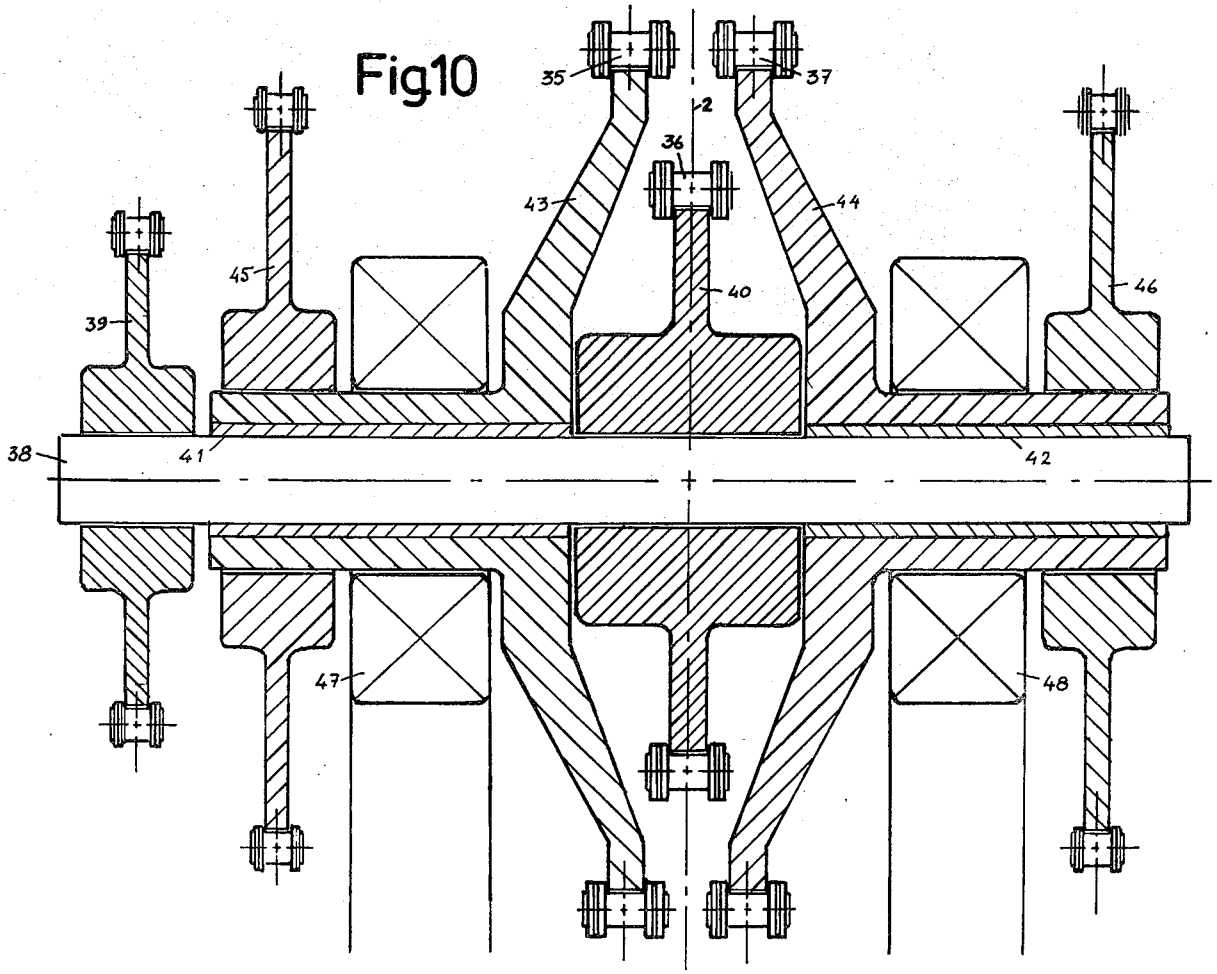
Figure 13:
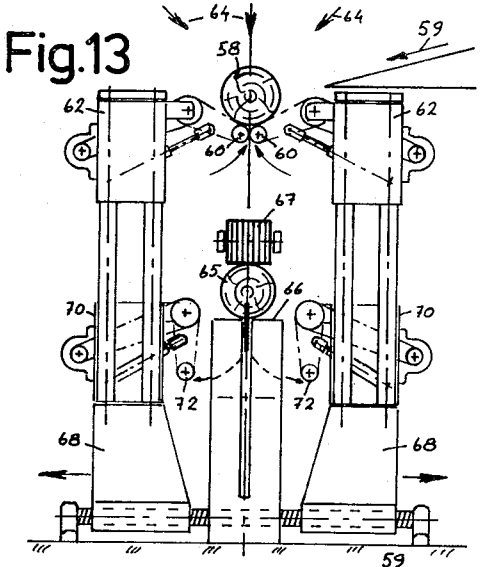
Figure 14:
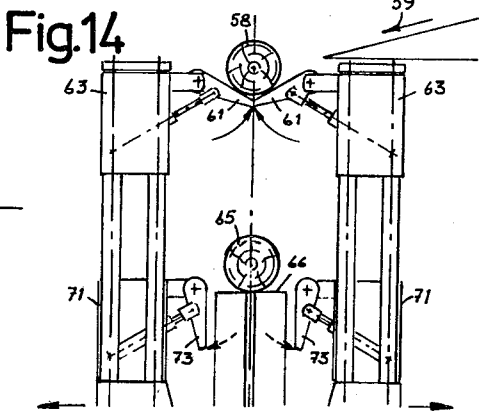
Figure 12:
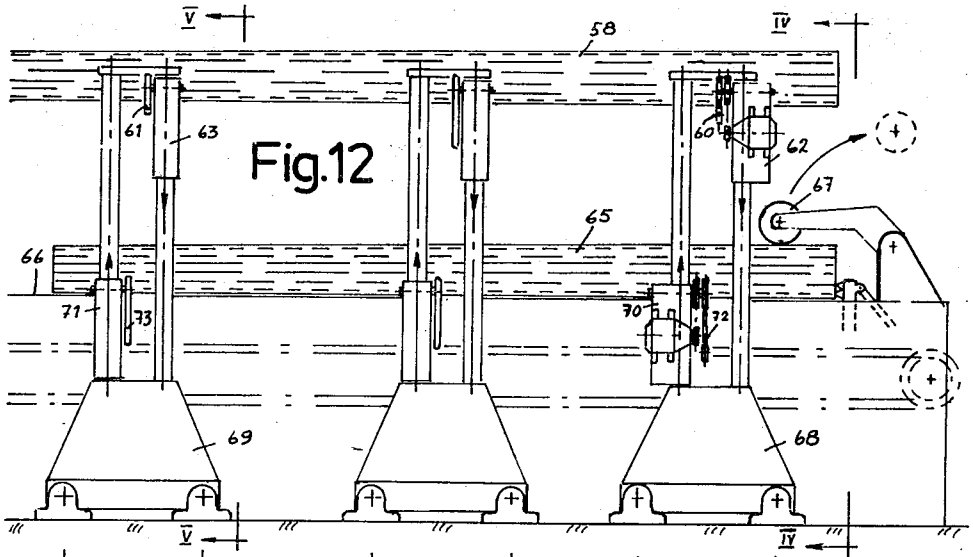
Figure 11:
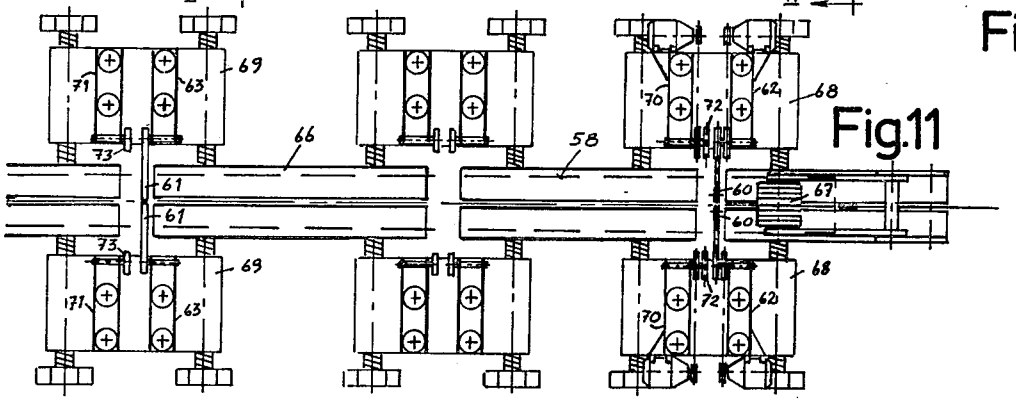

So that the invention will be more readily understood and further features thereof made apparent, an exemplary embodiment of an arrangement according to the invention will now be described with reference to the accompanying drawings, in which FIG. 1 illustrates an arrangement according to the invention in plan view, FIG. 2 is a view taken on the line I—I in FIG. 1, FIG. 3 is a view taken on the line II—II in FIG. 2, FIG. 4 is, in principle, the same view as that shown in FIG. 3, but with the log transfer means being shown in different working positions, FIG. 5 is a cut-away view of the saw table and one of the feed chains together with a dogging means, FIG. 6 is a view similar to FIG. 5 but showing another feed chain together with dogging means, FIG. 7 is a view similar to FIGS. 5 and 6 but showing a third feed chain including a dogging means, FIG. 8 is a view taken on the line III—III in FIG. 7, FIG. 9 is a view similar to FIG. 8 but seen from above, FIG. 10 is a cut-away view of the drive station of the feed chains, FIG. 11 illustrates a further embodiment of the invention in plan view, FIG. 12 is a view similar to FIG. 11 but seen from the side, FIG. 13 is a view taken from the line IV—IV in FIG. 12, FIG. 14 is a view taken on the line V—V in FIG. 12.

FIGS. 1, 2 and 3 illustrate in dash lines a log 1 lying on an aligning means on an alignment line 2. The butt ends of all logs lie on the line 3. In the alignment line, the logs rest on a rotating device 4 and on a V-shaped support 5, which is located nearest the top end of the logs. As will be understood, the V-shaped supports may also comprise rotating devices. A suitably positioned sensing or detecting means, in the illustrated embodiment cameras 6, senses the shape of the logs and, if a log is crooked, instructs the rotating device, via a data processor, to rotate the log until the curved or crooked part thereof is oriented in the desired position, normally vertically. As will be understood, both the detection of crooked or curved log parts and rotation of the log can be effected by an operator. Similarly, the logs may be positioned so that the butt ends of the logs enter the saw first and the line of coincidence 3 can be located nearest the saw.

For the purpose of moving the logs from the alignment line to the saw line 7, there is provided a number of transfer devices arranged so as to be able to handle logs of lengths between a maximum and a minimum length. Three such log-transfer devices 8, 9 and 10 are shown in FIGS. 1 and 2. In the illustrated embodiment, the log-transfer device 8 is used at the butt end of each log, while the log-transfer device 10 is used at the top end of respective logs. Each of the log-transfer devices comprises a raisable and lowerable device 11, 12 and 13. On these devices are arranged guides 14, 15 and 16 along which slides 17, 18 and 19 are able to move in a direction towards and away from the sawline 7 as seen from the aligning device. The manner in which the slides are displaced laterally has not been shown, although such movement can be effected, for example, by means of operating cylinders. The V-shaped log carriers 20, 21 and 22 are arranged on the upper side of the slides. When a log has been rotated to the desired position of adjustment, the log is lifted out of the aligning device by the log carriers 20 and 22. As soon as the log rests solely on the log carriers, the sensing or detecting devices are suitably caused to again sense the shape and position of the log, thereby to check whether the log has been disturbed from its aligned position while being lifted from the aligning device.

FIG. 4 illustrates schematically the different working positions of the log carriers. Position 23 is a rest position, from which the log carriers lift a log from the aligning device to the position 25 in the direction of arrow 24. Subsequent to completing a log-sensing operation, the log carriers are moved in the direction of arrow 26 to a waiting position 27 immediately above the saw table 28. Because of the design and construction of the log carriers, the aligning device has, herewith, been relieved for the intake of new logs. When the rear end of a preceding log lying on the saw table passes the forward end of the next log in line resting on the log carriers, the log carriers are lowered in the direction of arrow 29 to position 30, beneath the surface of the saw table to then return to the rest position 23 in a direction of arrow 31.

When the log carriers lower the log in the direction of arrow 29, the log comes to rest on the saw table. In order to prevent the position of alignment of the log from being changed, a pressure means is arranged to come into operation, said pressure means in the illustrated embodiment having the form of a non-driven pressure roller 33 arranged to pivot downwardly from above in the direction of arrow 32. This pressure roller shall be urged against the upper side of the log at a point in time sufficiently early to prevent the log from changing its position when the underside of the log comes into contact with the saw table. To facilitate this, lowering of the log in the direction of arrow 32 takes place in a vertical direction.

If the sensing or detecting means 6 has detected that the log is not positioned laterally as desired, the position of the log can readily be corrected prior to placing the log on the saw table, by causing the log carriers 20 and 22 to each take a lateral position relative to the saw line which adjusts the log to the desired position. In this way, for example, one side of the log can also be laid parallel with the saw line and at a desired distance therefrom.

In the illustrated embodiment, it is shown how the curvature and position of a log is checked above the alignment means. As will be understood, this can be arranged in a number of ways. For example, a log-curve sensing device can be placed above the aligning means, while a log-position sensor can be placed above the saw table.

FIGS. 5 to 10 illustrate the feed means by which a log 34 resting on the saw table 28 and held by the pressure roller 33 is advanced. This feed means comprises, in the illustrated embodiment, three endless, driven chains 35, 36 and 37 extending beneath the table 28. A drive station for the feed chains is illustrated in FIG. 10. The feed chain 36 extends over a toothed wheel 40 which is driven by a shaft 38 driven by a motor (not shown). Fixedly arranged on the shaft 38 is a transmission wheel 39. Also arranged on the shaft 38 are bearing bushings 41 and 42, on which toothed wheels 43 and 44 are arranged for free rotation. The toothed wheel 43 has a tubular flange on which a transmission wheel 45 is mounted, which transmission wheel drives the toothed wheel 43 from a motor, not shown, and therewith the feed chain 35 extending over said wheel. Fixedly connected to the toothed wheel 44 is a transmission wheel 46, which drives the toothed wheel 44 from a motor, not shown, and therewith the feed chain 47 extending over said wheel. Arranged externally of the tubular flanges of the toothed wheels 43 and 44 are bearings 47 and 48 for supporting the drive station.

Each feed chain 35, 36 and 37 suitably has two dogging means arranged at a distance from each other. FIG. 5 is a cut-away view illustrating how the feed chain 35 guidingly runs in a groove in the saw table 28. The dogging means 49 is mounted on the chain and extends vertically therefrom above the saw table and moves in a groove 50 therein. The dogging means is guided laterally by blocks 51 gliding against the walls of the groove 50. FIG. 6 illustrates in a similar manner how the dogging means 52 moving in the same groove 50 is mounted to the chain 36 which guidingly moves in a further groove in the saw table 28. FIG. 7 illustrates how the dogging means 53 moving in said groove 50 is mounted to the chain 37, which guidingly moves in a further groove in the saw table. FIGS. 8 and 9 are a sideview and planview respectively of the dogging means 53. The dogging means is pivotally mounted to the chain 37 and is supported rearwardly by support 54 pivotally mounted to the chain. If the chain has long links and is sufficiently tensioned, the dogging means may be fixedly mounted to respective chains without supports. The sides of the dogging means facing the logs are provided with teeth 55 so arranged that they can penetrate the end surface of the logs thereby preventing them from moving laterally or rotating, and to be readily be drawn out of the logs when releasing the same. To facilitate this latter feature, the teeth may be pivotable in the vertical direction.

In previously known feed devices of this kind, only one chain, normally having two dogging means, has been used, and the upper part of said chain has been placed in the saw table close to the underside of the logs. This has meant that short logs must wait before the next dogging means has been able to move into engagement, and that the alignment of logs on one side of the saw line has not been possible, since the transfer or lifting arms would have contacted the chain.

In the illustrated embodiment of the invention, these two disadvantages are eliminated by the use of a plurality of mutually independent feed chains provided with respective dogging means, and by the fact that the chains have been placed so far beneath the sawtable that the transfer arms or log carriers have room to pass without contacting the chains. The illustrated positioning of the chains and the design of the chain wheels affords a width between the outer sides of the outer chains of such small dimension, that the chains are able to pass through the saw between the sawblade if so desired. It will be understood that the number of chains used may be greater or smaller than the illustrated number.

The illustrated feed means has the following mode of operation. One of the dogging means, e.g. the means of the chain 35, rests in a waiting position close to the line 3. Immediately after a log has been placed on the sawtable 28, the chain is started up and the teeth 55 of the dogging means enter the log and move the same in the direction of arrow 56. As the log is now prevented from rolling to one side from its aligned position by the teeth 55, the pressure roller 33 is lifted to its rest position. During transport of the log, the log is prevented from being moved laterally partly by the teeth 55 and partly by longitudinally extending serrations 57 in the upper side of the saw table. When the chain 35 is started up, the chain 36, for example, is also started up and moves its dogging means forward, which in turn is stopped in the waiting position and awaits the arrival of the next log in line. If the time taken to place the logs in the sawline and to start advancement of the logs towards the saw is excessively long, the speed of the chain can be increased until the excessive space between sequential logs has been reduced, whereafter the speed of the chain is decreased to the predetermined feeding speed before the leading end of the log has reached the saw. If a third chain 47 is also provided, this chain has meanwhile moved one of its dogging means to the waiting position in readiness to receive the next log in line. Immediately before the leading end of a log reaches the saw, a pressure means located above the log urges said log, in a known manner, down against the serrations of the saw table. The trailing end or rear end of the log is prevented from moving laterally or from rotating by the teeth of the dogging means.

As will be understood, the invention is not restricted to the illustrated and described embodiments, but can be modified within the scope of the following claims.

For example, the aforedescribed aligning means, sensing or detecting means, and log-transfer means may serve known feed means comprising a conveyer, divided for passage of the log-transfer arms, without any upstanding dogging means but with one or more pressure means acting from above and intended to hold the logs in their position of alignment. Further, instead of the pressure roller 33, there can be provided a pressure means which follows the log. Similarly, when the saw mill is to meet high capacity requirements, the log lifting or transferring devices may be duplicated and log-rotating devices and log-transferring devices can also be placed on the other side of the saw line, whereat each alternate log is suitably taken in from the left and the remaining logs from the right. Since rotation of the logs to orient any curves therein is the most time consuming operation, the logs can also be pre-sorted, so that those logs which need to be rotated can be taken to one side of the saw line, where said logs are sensed, rotated and oriented, before being lifted down to the saw table, while those logs which do not need to be rotated can be sent to the other side of said saw line.

If the capacity requirement of the mill is not excessively high, and/or the logs are so straight that they seldom or never need to be rotated, the sensing means and, optionally, also the log-rotating means can be arranged above the saw table. One such embodiment is illustrated in FIGS. 11, 12, 13, 14. A log 58 is rolled in the direction of arrow 59 down into the measuring position, where the rear end of the log rests on rotating arms 60, and the forward end of the log rests in carrier arms 61 placed in a V-shaped configuration. The rotary arms 60 are each pivotally connected to a holder 62 arranged for movement in the vertical direction. These holders are so arranged that they constantly move together vertically. The carrier arms 61 are also connected to vertically movable holders 63 which also constantly move together vertically. A sensing device, here shown symbolically by arrows 64, senses whether the log needs to be rotated, said rotation of the log being effected by the rotary arms 60. The sensing means then examines the position of the log and sends to the data processing apparatus information relating thereto. When the trailing end of a preceding log 65 passes the forward end of the log 58, the holders 62 and 63 are lowered until the log 58 rests on the saw table 66 where it is held in position by the pressure roller 67, as beforedescribed. Before the log reaches the saw table, the lateral position of the log can be corrected, upon an order given by the data processing apparatus, by carriers 68 and 69 respectively, which are able to be moved laterally independently of one another. When the log rests on the saw table, the rotating and carrier arms 60 and 61 respectively are moved to a rest position, the holders 62 and 63 are lifted up to the upper positions, whereafter the rotating and carrier arms are again moved out to receive the next log in line. For the purpose of increasing the capacity of the sawing machine, the rotating and carrier arms, and the holders, may be duplicated, as illustrated in the drawing. In this case, the additional holders 70 and 71 are raised and the additional rotating and carrier arms 72 and 73 are moved out, at the same time as the holders 62 and 63 are lowered and the rotating and carrier arms 60 and 61 are moved in.

Although the above description is solely concerned with the alignment and feeding of logs, it will be understood that the described devices and arrangements, with slightly modified form without departing from the concept of the invention, can also be used to align, sense, transfer and measure blocks or like work pieces. In such cases, there is used in the alignment position flat supports having centering arms for roughly centering a block. The log carriers of the log-lifting or transferring means than have the form of flat block carriers. In other respects the procedure may be approximately the same as that described above.

I claim:

1. An arrangement in a sawing machine or a like processing machine for feeding elongate workpieces, such as logs in particular, up to and through the sawing machine, said arrangement comprising a stationary support table for supporting the workpieces over their entire length, said table extending on the infeed side of the sawing machine parallel to the desired feed line for the workpieces and at least up to the sawing machine; and conveyor means for engaging workpieces resting on said support table and feeding said workpieces along said table in direction parallel to said feed line up to and into the sawing machine, said conveyor means including at least two endless conveyor chains provided with individual driving means and located beneath said support table to run in vertical planes which are parallel and located close to the vertical plane through said feed line, each of said conveyor chains being provided with at least one dog member permanently attached to the conveyor chain in such a manner that it projects in vertical direction outwards from the conveyor chain and having a narrow lateral dimension, said dog members on said individually driven conveyor chains being attached to their respective conveyor chains in a manner such that all dog members move in a common vertical plane substantially coinciding with the vertical plane through said feed line and having such a vertical extension that they, when located on the upper flight of their respective conveyor chains, project above the surface of said support table so as to be able to engage and act against the rear end surfaces of workpieces resting on said support table for feeding the workpieces up to and in to the sawing machine, and said support table being provided with a common guide slot for said dog members extending in the vertical plane through said feed line.

2. An arrangement as claimed in claim 1, wherein said dog members are laterally guided against the sidewalls of said slot in said support table.

3. An arrangement as claimed in claim 1, wherein each of said conveyor chains has at its one end a driving sprocket wheel connected to the associated driving means and at its opposite end an idle sprocket wheel, said driving sprocket wheels of all said conveyor chains having a common axis of rotation and said idle sprocket wheels of all said conveyor chains also having a common axis of rotation.

4. An arrangement according to claim 1, and a raisable and lowerable pressure element (33) arranged to be lowered to a position in which it lies against the upper side of a workpiece (34) so as to urge the workpiece against the saw table (28) for preventing rotation of the workpiece around its geometric longitudinal axis and also to prevent lateral displacement of said workpiece before feeding of said workpiece towards the sawing machine commences.

5. An arrangement according to claim 1 in a sawing machine which at its infeed side has an alignment position (2) which is separate from and located at a distance from the saw table (28) and the feed line (7) and in which a workpiece (1) can be aligned with its longitudinal axis parallel to the feed line (7) and/or be rotated about its longitudinal axis to a desired sawing position, characterized in that said arrangement includes at least two log-transfer devices (8, 10) arranged to act on the forward and rearward part of the workpiece respectively and to move said workpiece from the alignment position and place said workpiece down on to the saw table (28) without changing the longitudinal alignement of the workpiece and its position of rotation about said longitudinal axis, whereat said log-transfer devices are arranged to move the workpiece in a substantially vertical direction of movement, at least in the vicinity of the saw table.

6. An arrangement according to claim 5, in which the alignment position (2) is located substantially on one side of the saw table (28) and the feed line (7), and in which stationary support means (4, 5) for the workpiece (1) during an aligning operation are located in the alignment position, characterized in that each log-transfer device (8, 10) includes a carrier element (20) which is arranged to carry the workpiece in a manner to prevent the same rotating about its longitudinal axis, and which is movable in a circuitry movement (22, 26, 29, 31) lying in a vertical plane, said movement being substantially completely vertical both in the vicinity of the alignment position (2) and in the vicinity of the saw table (28).

7. An arrangement according to claim 5 in which the alignment position is located substantially immediately above the saw table (66) and the feed line, characterized in that each log-transfer device comprises two carrier arms (60) which are arranged for pivotal movement in a vertical direction between a substantially horizontal and a substantially vertical position, said carrier arms being carried by two carriages (62) arranged on a respective side of the vertical plan containing the alignment position and the feed line, said carriages being synchronously movable in a vertical direction between a position on a level with the alignment position and a position on a level with the saw table.

8. An arrangement according to claim 7, characterized in that the carrier arms (60) are provided with means for rotating a workpiece (58) carried by said arms around its longitudinal axis.

9. An arrangement according to claim 5, charcterized in that the two log-transfer devices are individually adjustable in a direction perpendicular to the feed line (7), so that the workpiece can be placed down on the saw table (28) with the longitudinal axis of said workpiece displaced laterally and/or positioned obliquely relative to the feed line (7).

10. An arrangement according to claim 5, characterized in that the saw table (28) is provided with recesses above the upper parts of the feed chains (35,36,37) for passage of the log-transfer devices when placing a workpiece onto the saw table.

11. An arrangement as claimed in claim 1, comprising a raisable and lowerable pressure member arranged in its lowered position to press against the upper side of a workpiece resting on said support table so as to urge the workpiece against the support table for preventing rotation of the workpiece about its longitudinal axis and also to prevent lateral displacement of the workpiece before it is engaged by one of said dog members and its feeding towards the sawing machine commences.

12. An arrangement as claimed in claim 1, wherein at least a part of each of said conveyor chains run in a common vertical plane.

13. An arrangement as claimed in claim 1, wherein said conveyor chains extend through the sawing machine to the outfeed side thereof.

14. An arrangement in a sawing machine or a like processing machine for feeding workpieces (34), such as logs in particular, to and through the sawing machine, said arrangement comprising a stationary saw table (28) extending on the infeed side of the saw machine parallel with the desired feed line (7) for the workpieces at least up to the machine; and feed means arranged to engage a workpiece resting on the saw table and to feed said workpiece along said table up to and into the sawing machine, characterized in that said feed means comprises at least two individually drivable endless feed chains (35, 36, 37) extending in vertical planes beneath the saw table (28) parallel with the feed line, whereat each feed chain is provided with at least one dogging means (49,52,53) which when located on the upper part of the feed chain moves in a groove (50) arranged in the saw table (28), said groove being common to the dogging means of all feed chains, and projects up out of said groove above the surface (57) of the saw table in a manner such that the upwardly projecting part of said dogging means is able to act on the rear end surfaces of a workpiece (34) resting on the saw table and to feed said workpiece to and into the sawing machine, in which the alignement position is located substantially immediately above the saw table (66) and the feed line, characterized in that each log-transfer device comprises two carrier arms (60) which are arranged for pivotal movement in a vertical direction between a substantially horizontal and a substantially vertical position, said carrier arms being carried by two carriages (62) arranged on a respective side of the vertical plan containing the alignment position and the feed line, said carriages being synchronously movable in a vertical direction between a position on a level with the alignment position and a position on a level with the saw table.

15. The combination of claim 14, an arrangement according to claim 14, characterized in that the carrier arms (60) are provided with means for rotating a workpiece (58) carried by said arms around its longitudinal axis.

* * * * *